US009882280B2

(12) United States Patent
Gillard et al.

(10) Patent No.: US 9,882,280 B2
(45) Date of Patent: Jan. 30, 2018

(54) FLATTENED DIHEDRAL-SHAPED DEVICE POSSESSING AN ADAPTED (MAXIMIZED OR MINIMIZED) EQUIVALENT RADAR CROSS SECTION

(71) Applicants: Institut National Des Sciences Appliquees, Rennes (FR); CNRS—Centre Nationale de la Recherche Scientifique, Paris (FR)

(72) Inventors: Raphael Gillard, Rennes (FR); Stephane Meric, Rennes (FR)

(73) Assignees: INSTITUT NATIONAL DES SCIENCES APPLIQUEES, Rennes (FR); CNRS—CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 152 days.

(21) Appl. No.: 14/441,741

(22) PCT Filed: Nov. 7, 2013

(86) PCT No.: PCT/EP2013/073306
§ 371 (c)(1),
(2) Date: May 8, 2015

(87) PCT Pub. No.: WO2014/072431
PCT Pub. Date: May 15, 2014

(65) Prior Publication Data

US 2015/0263425 A1 Sep. 17, 2015

(30) Foreign Application Priority Data

Nov. 8, 2012 (FR) ..... 12 60615

(51) Int. Cl.
*H01Q 15/18* (2006.01)
*H01Q 3/46* (2006.01)
*H01Q 15/00* (2006.01)

(52) U.S. Cl.
CPC ..... *H01Q 3/46* (2013.01); *H01Q 15/0013* (2013.01); *H01Q 15/18* (2013.01)

(58) Field of Classification Search
CPC ..... H01Q 3/46; H01Q 15/0013
(Continued)

(56) References Cited

U.S. PATENT DOCUMENTS 3,417,398 A * 12/1968 Lewis ..... G01S 13/756 342/6
4,104,634 A * 8/1978 Gillard ..... G01S 13/75 342/33
(Continued)

FOREIGN PATENT DOCUMENTS

EP 1120856 A1 8/2001

OTHER PUBLICATIONS

A. R. Chandran, M. Gopikrishna, C. K. Aanandan, P. Mohanan and K. Vasudevan, "Radar cross-section enhancement of dihedral corner reflector using fractal-based metallo-dielectric structures," in Electronics Letters, vol. 42, No. 20, pp. 1135-1136, Sep. 28, 2006.*
(Continued)

*Primary Examiner* — Marcus E Windrich
(74) *Attorney, Agent, or Firm* — David D. Brush; Westman Champlin & Koehler, P.A.

(57) ABSTRACT

A dihedral shaped device is provided, which includes two plates forming between them an angle of [pi]−2[alpha], where 0<[alpha]<[pi]/4. Each plate has a ground plane, at least one dielectric layer and a network of radiating elements. An incident wave is reflected by the device by virtue of a double reflection from both plates. The network of
(Continued)

radiating elements of each plate allows a phase shift to be generated, from the exterior towards the centre of the dihedron, along an axis perpendicular to an axis of intersection of the two plates, according to a set phase law, allowing a deviation to be introduced relative to a specular reflection for a given operating frequency.

10 Claims, 5 Drawing Sheets

(58) Field of Classification Search
USPC ..... 342/5–12
See application file for complete search history.

(56) References Cited

U.S. PATENT DOCUMENTS

| | | | | | |
|---|---|---|---|---|---|
| 4,352,106 | A * | 9/1982 | Firth | H01Q 15/18 | 342/7 |
| 4,695,841 | A * | 9/1987 | Billard | F41H 11/02 | 342/8 |
| 5,670,959 | A * | 9/1997 | Nagura | G01S 13/75 | 342/6 |
| 7,920,100 | B2 * | 4/2011 | Brown | F41C 27/00 | 342/10 |
| 8,466,776 | B2 * | 6/2013 | Fink | G06K 19/0675 | 310/313 R |
| 2003/0214429 | A1 * | 11/2003 | Nakamura | H01Q 1/3225 | 342/5 |
| 2008/0266164 | A1 * | 10/2008 | Nasvall | H01Q 1/28 | 342/7 |
| 2013/0185847 | A1 * | 7/2013 | Steenson | H01Q 15/18 | 2/243.1 |

OTHER PUBLICATIONS

International Search Report and Written Opinion dated Jan. 20, 2014 for corresponding International Patent Application No. PCT/EP2013/073306, filed Nov. 7, 2013.

French Search Report and Written Opinion dated Sep. 12, 2013 for corresponding French Patent Application No. 1260615, filed Nov. 8, 2012.

English translation of the International Preliminary Report on Patentability dated May 8, 2015 for corresponding International Patent Application No. PCT/EP2013/073306, filed Nov. 7, 2013.

Chandran A R et al: "Radar cross-section enhancement of dihedral corner reflector using fractal-based metallo-dielectric structures", Electronics Letters, IEE Stevenage, GB, vol. 42, No. 20, Sep. 28, 2006 (Sep. 28, 2006), pp. 1135-1137, XP006027458.

W. Anderson: "Consequences of nonorthogonality on the scattering properties of dihedral reflectors", IEEE. Transactions on Antennas and Propagation, vol. 35, No. 10, Oct. 1, 1987, (Oct. 1, 1987), pp. 1154-1159, XP055078739.

Francesca Venneri et al: "Investigation of printed reflectarrays as permanent scatterers in SAR interferometry", Microwave and Optical Technology Letters, vol. 37, No. 1, Apr. 5, 2003 (Apr. 5, 2003), pp. 18-20, XP055078745.

Toh B Y et al: "Retrodirective array radar cross-section performance comparisons", High Frequency Postgraduate Student Colloquium, 2000 Sep. 7-8, 2000, Piscataway, NJ, USA, IEEE, Sep. 7, 2000 (Sep. 7, 2000), pp. 65-70, XP10514412.

* cited by examiner

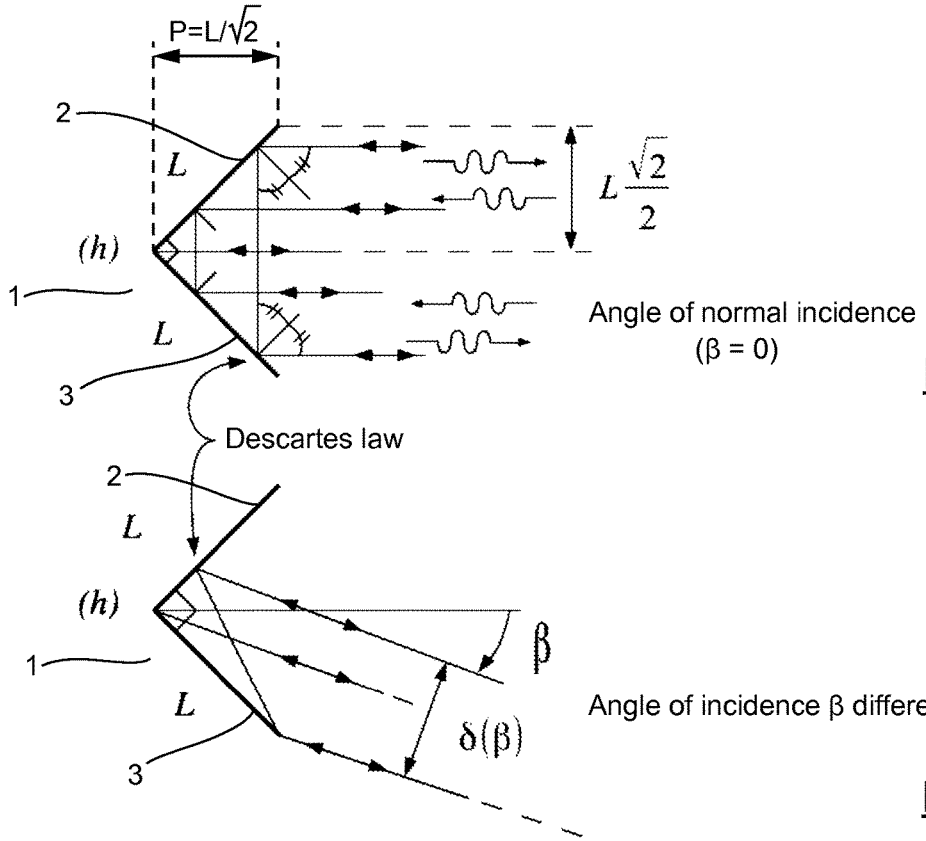
Fig. 1A
Fig. 1B
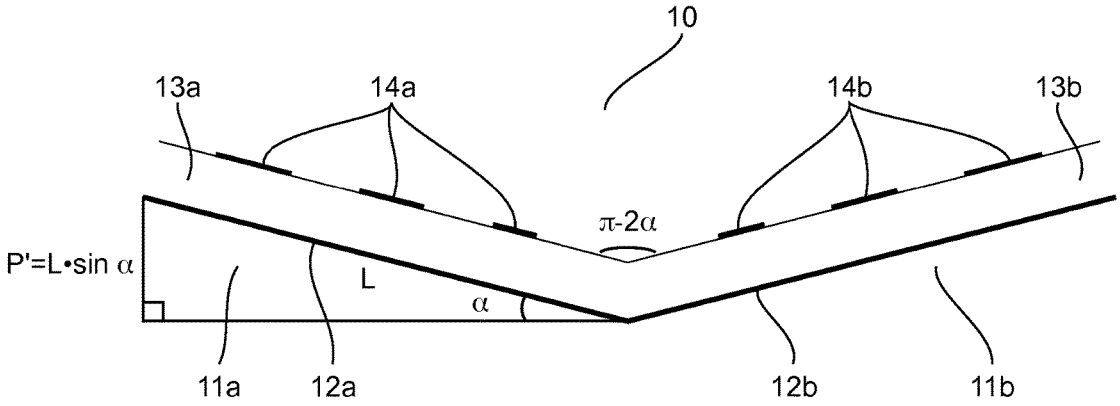
Fig. 2

FLATTENED DIHEDRAL-SHAPED DEVICE POSSESSING AN ADAPTED (MAXIMIZED OR MINIMIZED) EQUIVALENT RADAR CROSS SECTION

1. CROSS-REFERENCE TO RELATED APPLICATIONS

This Application is a Section 371 National Stage Application of International Application No. PCT/EP2013/073306, filed Nov. 7, 2013, the content of which is incorporated herein by reference in its entirety, and published as WO 2014/072431 on May 15, 2014, not in English.

2. FIELD OF THE INVENTION

The field of the invention is that of dihedral-shaped or dihedral devices comprising two plates.

More specifically, the invention pertains to a technique for adapting (maximizing or minimizing) the equivalent radar cross-section (RCS) in a mono-static configuration of a device having flattened dihedral shape, i.e. a dihedral or dihedron, the two plates of which mutually form an angle of $\pi-2\alpha$, with $0<\alpha<\pi/4$.

The invention can be used especially for any application where it desired to adapt (especially to maximize or minimize) the RCS of an object.

For maximizing the RCS, it is sought to make an object very easily detectable by a monostatic radar. The present invention can be used for example on a bicycle in order to make it easier to detect by means of an automobile anti-collision radar. Equivalent applications are possible for the detection of vessels (especially light vessels such as sailboats) by coastal radars or radars on board other vessels. Here again, it can be sought to prevent collision by using a compact system. In general, all applications requiring a system that must meet an incident wave, whatever its orientation, are concerned by this invention when it is used to maximize RCS: i.e. applications relating to radiofrequency identification, tracking system, RCS agility, etc.

In the case of minimizing RCS, the invention makes it possible to address stealth applications. It is sought to make an object hard to detect by radar.

3. TECHNOLOGICAL BACKGROUND

3.1 Maximizing the RCS

A first prior-art solution used to maximize the RCS (i.e. to obtain a big RCS) consists of the use of a metal dihedron.

FIGS. 1A and 1B illustrate the principle of reflection in a metal dihedron 1 having an internal dihedral angle (the angle between the two metal plates 2, 3 forming the metal dihedron 1) of $\pi/2$ for different angles of incidence $\beta$ ($\beta=0$ in FIG. 1A and $\beta\neq0$ in FIG. 1B). In other words, the two plates 2, 3 mutually form an angle of $\pi-2\alpha$, with $\alpha=\pi/4$.

It can be seen that the incident wave is reflected in the direction from which it has come, through a double reflection on each of the metal surfaces 2, 3 of the metal dihedron. It is this double specular reflection that maximizes the RCS of the object (the metal dihedron) by virtue of Descartes law of reflection. The behavior is similar to that of a retro-reflector in optics. The principle remains the same for a big variation of the angle of incidence $\beta$ (about ±15° for the major lobe). In other words, the interesting property of a metal dihedron is that it has an almost constant RCS (with a variation of 3 dB relative to the maximum RCS) for a variation in the angle of incidence $\beta$ of about ±20° relative to the direction of incidence of the zero incidence configuration.

This first prior-art solution has a major drawback: the two metal plates, having a dimension of L×L for example, must form an angle of $\pi/2$ in order that the double reflection mechanism may be efficient (i.e. in order that it may have an angle of the incident wave that is equal to the angle of the reflected wave). This results in a 3D object with a relatively large space requirement in depth ($P=L/\sqrt{2}$) (see FIG. 1A).

A second prior-art solution consists of the use of a Van Atta array. In this case, this is a single, plane printed array. However, such an array requires printed interconnection lines between the different elements of the array. These lines cause losses, parasitic radiation and complexity in design.

A third prior-art solution consists of the use of heterodyne retrodirective array type structures that use the principle of phase conjugation for the re-sent signal. These structures are more difficult to implement since they are based on an active structure (multiplication with a local oscillator oscillating at a frequency double that of the received signal).

3.2 Minimizing the RCS

There are several known techniques for reducing the RCS of objects (and therefore of a dihedron) in the case of a mono-static radar configuration.

A first family of methods modifies the surface impedance of the faces of a dihedron, for example by depositing an absorbent material on the faces of the dihedron. Thus, the mechanisms of reflection are attenuated by the presence of this absorbent material.

We must also refer to the materials that absorb the waves emitted by radars (also known as RAMs or Radar Absorbent Materials). These RAMs can be described as having a heterogeneous structure of several layers of composite materials in which the electromagnetic wave is absorbed (magnetic materials for example).

Another method which can be likened to the attenuation of the wave by the material is that of "trapping" the incident electromagnetic wave in the material by means of a particular geometry. This geometry is described in terms of a ground plane and a given thickness of material (the Salisbury screen).

Finally, it is also possible to set up combinations of different types of materials in order that the summation of the waves reflected by each of these materials will be destructive (by the combination of an AMC (Artificial Magnetic Conductor) type structure and a PEC (Perfect Electric Conductor) type structure).

Thus, all the solutions briefly described here above and dedicated to reducing the RCS in a mono-static radar configuration are essentially based on the absorption of the incident electromagnetic wave either by means of materials with special absorbent properties or by a particular geometrical arrangement of layers of materials.

4. SUMMARY OF THE INVENTION

In one particular embodiment of the invention a dihedral-shaped device is proposed, the device comprising two plates, characterized in that the two plates mutually form an angle of $\pi-2\alpha$, with $0<\alpha<\pi/4$. Each plate comprises a ground plane with at least one dielectric layer and an array of radiating elements, an incident wave being reflected by the device through double reflection on both plates. The array of radiating elements of each plate enables a phase shift to be generated from the exterior towards the center of the dihedron in following an axis perpendicular to an axis of intersection of the two plates, according to a determined phase law, making it possible to introduce a deviation relative to a specular reflection for a given operating frequency.

Thus, this particular embodiment of the invention relies on a wholly novel and inventive approach using two arrays of radiating elements (one in each plate of the dihedron) applying a same phase law but not in a same sense (each array produces a phase shift from the exterior to the center of the dihedron). Each array introduces an additional deviation relative to the specular reflection. It is thus possible to control the direction of a re-radiation of an incident wave whatever the aperture of the angle $\pi-2\alpha$ between the two plates (forming reflective planes).

This efficient operation can be maintained (with high or low RCS depending on the applications) even for a small angle $\alpha$, i.e. for a very open structure. Thus, a flattened dihedral structure is obtained, and this limits its depth (for example as illustrated in FIG. 2, a depth $P'=L\cdot\sin(\alpha)$, with plates having dimensions $L\times L$, instead of a depth $P=L/\sqrt{2}$, for the classic metal dihedron illustrated in FIG. 1A). One original feature of the present invention therefore relates to the fact that the structure is almost flat (if it is not completely flat as in the Van Atta array) but requires no line in addition to the radiating elements of the array (unlike in the case of the Van Atta array).

Yet another original feature of the present invention is that it is possible to have several special applications with distinct purposes such as increasing the RCS of the device, reducing the RCS of the device or embodiment obtaining an RCS that is variable in time.

In a first particular implementation, said phase law enables the device to reflect an incident wave in the direction from which it has come, in order to increase the equivalent radar cross-section of the device.

According to one particular characteristic, for an incident wave forming an angle $\alpha$ with the normal to the surface of those plates of the two plates that receive said incident wave, the deviation relative to the specular reflection is: $\pi/2-2\alpha$, towards the center of the dihedron.

According to one particular characteristic, for an incident wave forming an angle $\alpha$ with the normal to the surface of that one of the two plates that receives said incident wave, the phase law can be written as follows:

$\gamma=k_0\,d\,(\cos\alpha-\sin\alpha)$, where $k_0=2\pi c/f_0$ is the wave number at the working frequency $f_0$, and d is the pitch of the array.

In a second particular embodiment, said phase law enables a device to reflect an incident wave in a direction different from that which it has come in order to reduce the equivalent radar cross-section of the device.

In a third particular embodiment, the device comprises means for modulating said phase law as a function of the time enabling the equivalent radar cross-section of the device to be modulated as a function of the time.

According to one particular characteristic, the radiating elements are radiating elements each introducing a variable phase shift, and said modulation means comprise, for each array of radiating elements, a plurality of active circuits each controlling the phase shift of one of said radiating elements.

The invention also proposes other characteristics for the different particular implementations mentioned here above.

According to one particular characteristic, for each plate, the radiating elements are radiating elements printed on said at least one dielectric layer.

According to one particular characteristic, for each array of radiating elements, the phase shift between the two successive radiating elements from the exterior to the center of the dihedron in following said axis perpendicular to the axis of intersection of the two plates is obtained by a modification of at least one dimension of the radiating elements.

According to one particular characteristic, the pitch of each array of radiating elements is smaller than à $\lambda/2$, with $\lambda$ being the working wavelength.

According to one particular characteristic, each plate comprises at least one other array of radiating elements, making it possible to introduce a deviation relative to the specular reflection for another given operating frequency.

Thus, the number of possible operating frequencies is increased (multi-frequency operation).

According to one particular characteristic, the radiating elements are radiating elements each introducing a fixed phase shift.

In this case, the device is an entirely passive structure (unlike the heterodyne backfire arrays of the prior art), which makes them far simpler, less costly and entirely independent from the energy point of view.

5. LIST OF FIGURES

Other features and advantages of the invention shall appear from the following description, given by way of an indicative and non-exhaustive example and from the appended drawings, of which:

FIGS. 1A and 1B, already described with reference to the prior art, illustrate the principle of reflection of a classic metal dihedron;

FIGS. 2 and 3 present side views and views in perspective respectively of a dihedron-shaped device or dihedral device according to one particular embodiment of the invention;

6. DETAILED DESCRIPTION

In all the figures of the present document, the identical elements are designated by a same numerical reference.

6.1 General Principle of the Invention

In the present invention, it is the application of a phase shift between different radiating elements of a reflective array that produces the desired law of reflection for each plate of a dihedral-shaped device. In fact, the phase shift produced by each plate enables a deviation to be introduced into the specular reflection. It is thus possible to control the direction of re-radiation of the device whatever the aperture of the angle $\pi-2\alpha$ between the two plates (reflecting planes). It is thus possible to maintain efficient operation (high RCS for example) even for a small angle $\alpha$, i.e. for a very open structure. Thus, a structure printed on a flattened dihedron is obtained, and this limits its depth (see FIG. 2: $P'=L\cdot\sin(\alpha)$).

Here below in the description, a more detailed description is provided of the particular case where the phase law enables the device to reflect an incident wave in the direction from which it has come, in order to increase the equivalent radar cross-section (RCS) of the device.

Figure 3:
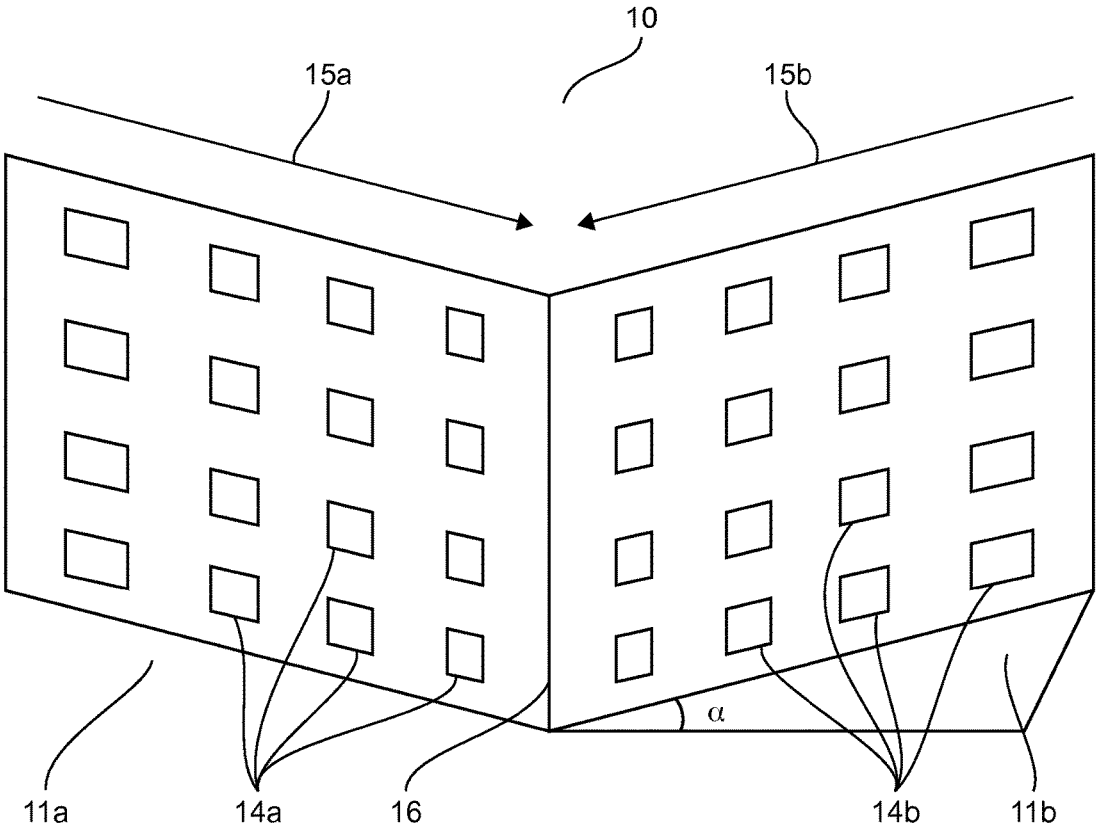

Referring now to FIGS. 2 and 3, we present a dihedral-shaped device 10 according to one particular embodiment of the invention.

The device 10 comprises two plates 11*a*, 11*b* mutually forming an angle $\pi-2\alpha$, with $0<\alpha<\pi/4$. Each plate 11*a*, 11*b* comprises a ground plane 12*a*, 12*b*, a dielectric layer 13*a*, 13*b* and a array of radiating elements 14*a*, 14*b* (also called reflector arrays). For each array, the radiating elements are radiating elements printed on the dielectric layer.

In one alternative embodiment, each plate comprises several dielectric layers.

In the example of FIGS. 2 and 3, the radiating elements are distributed in a single layer on the surface of the single dielectric layer. In one alternative embodiment, the radiating elements are distributed over several layers (this is a classic configuration in reflector array techniques in order to increase the bandwidth).

An incident wave is reflected by the device by means of a double reflection on the two plates 11*a*, 11*b*. It is assumed that the wave vector of the incident wave is contained in a plane simultaneously perpendicular to the two plates of the dihedron 10.

The array of radiating elements 14*a*, 14*b* of each plate 11*a*, 11*b* enables the production of a phase shift, from the exterior to the center of the dihedron along and axis (reference 15*a* for the left-hand plate and 15*b* for the right-hand plate) perpendicular to an axis 16 of intersection of the two plates, according to a determined phase law, enabling the introduction of a deviation relative to a specular reflection for a given operating frequency.

In the example of FIGS. 2 and 3, for each plate, the phase shift is obtained by a decrease in the size of the radiating elements towards the center of the dihedron (from left to right for the left-hand plate 11*a*, and from right to left for the right-hand plate 11*b*). For each plate, the phase law corresponds in this case to a negative phase shift increasing towards the center of the dihedron. The phase shifts produced by the arrays of radiating elements 14*a*, 14*b* of the two plates are therefore reversed relative to each other. Thus, the application of a phase shift between the different elements of each of the arrays 14*a*, 14*b* maximizes the RCS while at the same time releasing it from the constraint of orthogonality between the two faces (of the plates 11*a*, 11*b*) involved in the double reflection.

In the example of FIGS. 2 and 3, the phase shift of each array 14*a*, 14*b* is produced only by obtaining a variation in the geometry of the radiating elements, i.e. by modifying at least one dimension of the radiating elements (instead of taking radiating elements that are all identical as is the case with a classic array).

In the example of FIGS. 2, and 3, the radiating elements of the arrays 14*a*, 14*b* are rectangular patches. However, there are numerous other topologies of radiating elements that can be used to obtain the desired phase shift (annular patches, circular patches, slot-loaded patches, stub-loaded patches etc.). In every case, it is the modification of one or more dimensions of the radiating elements on the surface of the array 14*a*, 14*b* that produces the desired phase shift.

6.2 Reminder: Phase Law for a Single Reflector Plane

Figure 4:
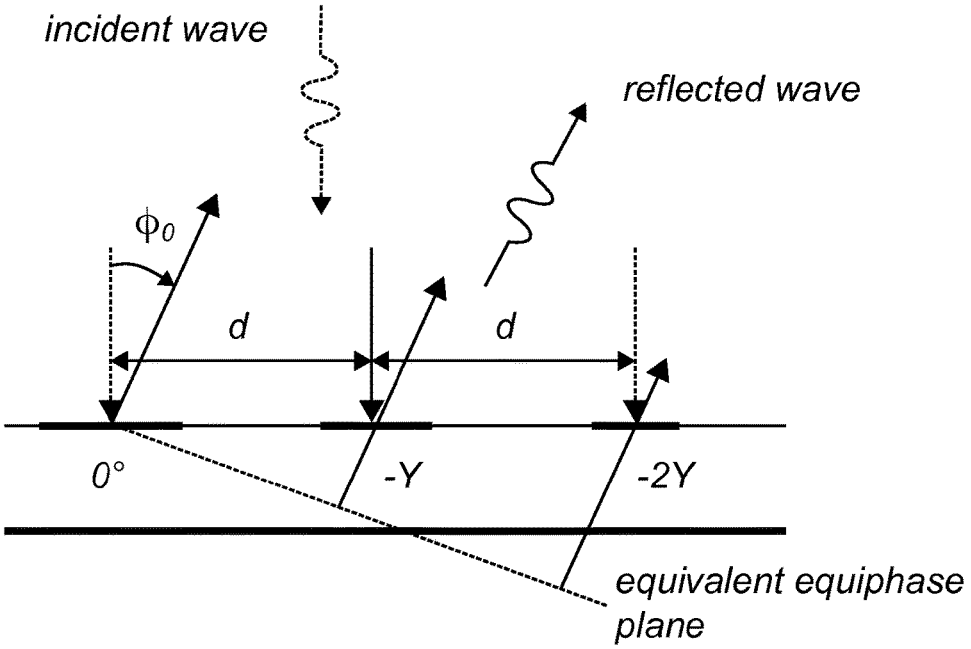
FIG. 4 illustrates the phase law of a phase-shifter array as well as its operation with a plane wave at normal incidence (angle of incidence $\beta$ equal to zero)

As illustrated in FIG. 4, when the elements of an array are illuminated with a plane wave in normal incidence, this plane wave undergoes a deviation at reflection that depends on the phase shift introduced by the elements of the array. The size of the elements of the array as well as the pitch d of the array therefore fix the phase shift between the two successive elements of the array in order to determine the phase law.

If the direction of the incident wave is normal to the plane of the phase-shifter array (angle of incidence $\beta$ equal to 0°), it is shown that to direct the direction of the wave reflected in the direction $\varphi_0$ ($\varphi_0$, being the positive angle as indicated in FIG. 4 with a decrease in the size in the radiating elements, on the deviation side), the phase shift $\gamma$ between two successive elements must be described by the relationship:

$$\gamma=k_0\, d\, \sin(\varphi_0)$$

where $k_0=2\pi/\lambda=2\pi c/f_0$ is the wave number at the working frequency $f_0$ and d is the inter-element distance (pitch of the array).

Figure 5:
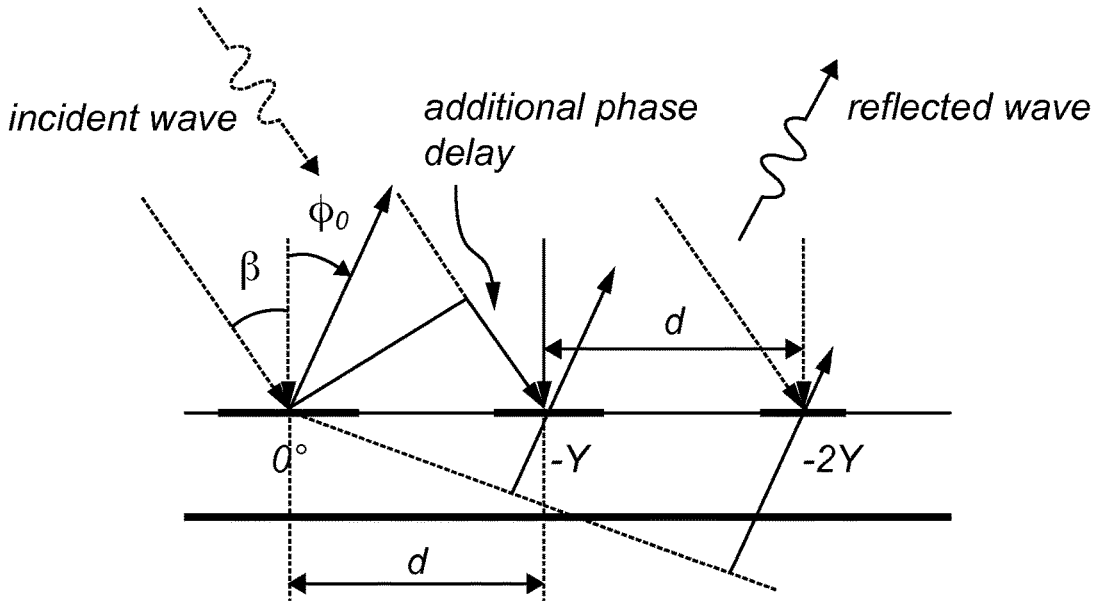
FIG. 5 illustrates the operation of the phase-shifter array of FIG. 4 where the incident wave introduces a phase delay relative to the configuration of the wave in normal incidence.

If the angle of incidence $\beta$ is different from 0°, two examples must be described:

Case 1 (see FIG. 5): the angle of incidence $\beta$ introduces an additional phase delay relative to the configuration of the wave in normal incidence and the new phase law $\gamma$ can be written as follows:

$$\gamma=k_0\, d\, \sin(\varphi)=k_0\, d\, \sin(\varphi_0)+k_0\, d\, \sin(\beta)$$

where $\varphi_0$ corresponds to the deviation of the reflected wave for the wave in normal incidence (see FIG. 4).

Figure 6:
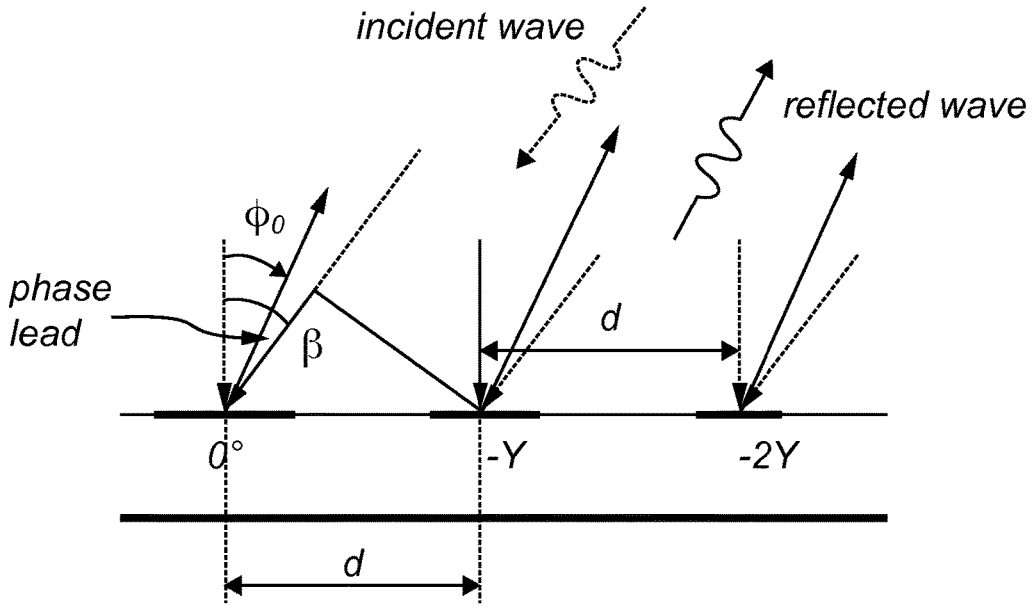
FIG. 6 illustrates the operation of the phase-shifter array of FIG. 4 when the incident wave introduces a phase lead relative to the configuration of the wave in normal incidence.

Case 2 (see FIG. 6): the angle of incidence $\beta$ introduces a phase lead relative to the configuration of the wave in normal incidence and the new phase law $\gamma$ can be written as follows:

$$\gamma=k_0\, d\, \sin(\varphi)=k_0\, d\, \sin(\varphi_0)-k_0\, d\, \sin(\beta)$$

with the same meaning for the angle $\varphi_0$ as in the case 1.

6.3 Geometry of the Problem

Figure 7:
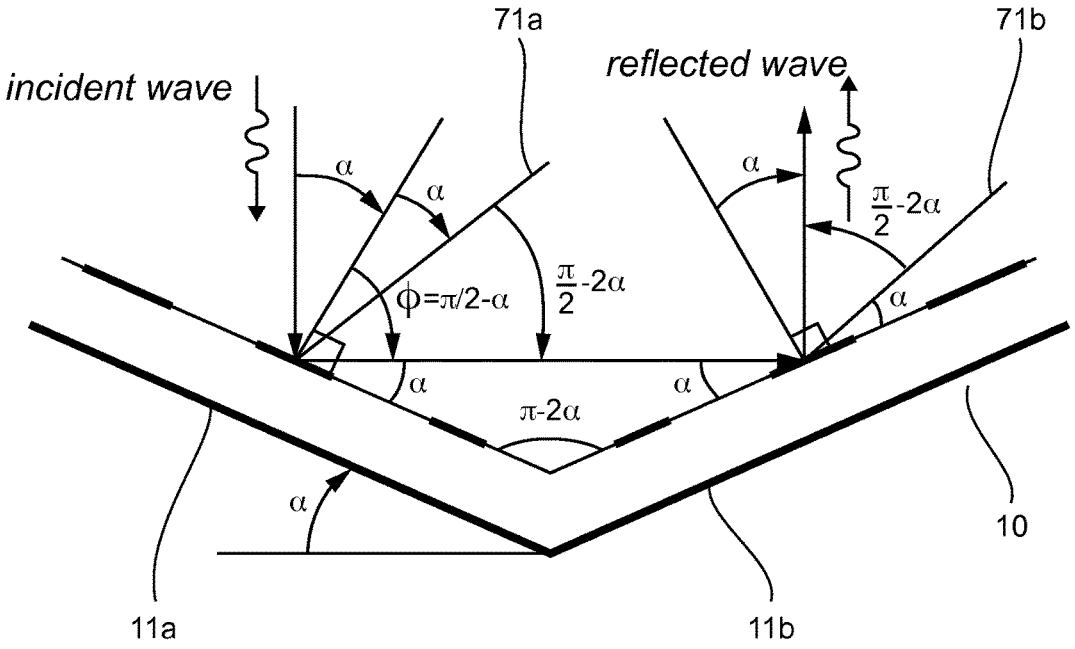
FIG. 7 illustrates the operation of the device of FIG. 2 for a plane wave in normal incidence relative to the equivalent backplane of the device.

FIG. 7 illustrates the operation of the device 10 of FIG. 2 for a plane wave in normal incidence relative to the rear equivalent plane of the device.

This FIG. 7 therefore describes the geometry of the problem of the dihedron known as the "flattened" dihedron when the incident wave is normal to the equivalent back-plane, i.e. when the incident wave forms an angle $\alpha$ with the normal to the surface of the phase shifter array of the left-hand plate 11*a* (normal of the surface of those plates 11*a*, of the two plates 11*a*, 11*b* that receive the incident wave). This configuration is called the "zero incidence configuration".

In this example, we describe the different angles of deviation that the incoming wave must undergo in the dihedron so that the outgoing wave of the dihedron will be reflected in the same direction as the incident wave. To this end, two conditions must be verified for each of the two plates 11*a*, 11*b*:

the phase shift between two successive elements (from the exterior to the center of the structure) must correspond to a delay described with a phase law γ; and this delay must be adjusted according to the value of the angle α and the corresponding deviation relative to the specular reflection must be fixed at (π/2−2α) towards the interior of the dihedron (in FIG. 7 the line referenced 71*a* represents the axis of specular reflection for the left-hand plate 11*a*, and the line referenced 71*b* represents the axis of specular reflection axis for the right-hand plate 11*b*).

It is shown that the phase law, for each of the two plates 11*a*, 11*b*, is written as follows: $\gamma=k_0\, d\,(\cos\alpha-\sin\alpha)$, with $k_0$ and d already defined further above.

This phase law applied by the array 14*a*, 14*b* of each of the plates 11*a*, 11*b* enables compensation for the aperture of the dihedron, in introducing the additional deviation of the beam relative to the specular reflection.

6.4 Limitation of the Variation of the Angle of Incidence β

We have indicated further above that the angle of entry of the ray into the dihedron could undergo an angle of deviation β different from 0°. Two examples applicable to the configuration of the dihedron therefore need to be described.

Figure 8:
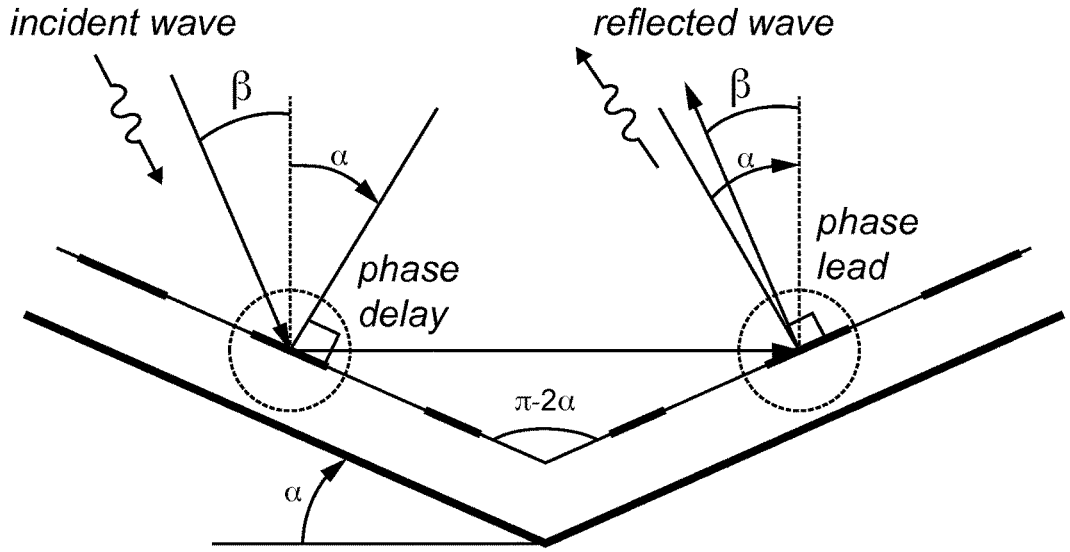
FIG. 8 illustrates the operation of the device of FIG. 2 when the incident wave provides a phase delay relative to the configuration of the wave in normal incidence on the left-hand plate (panel) of the device.

FIG. 8 illustrates the operation of the device of FIG. 2 in the first case, i.e. when the incident wave introduces a phase delay relative to the configuration of the wave in normal incidence on the left-hand plate (panel) 11*a* of the device 10. In the first example, it can be considered that, relative to the configuration in zero incidence (β=0), we are in the presence of the phenomenon of FIG. 5 for the left-hand plate 11*a* and then the phenomenon of FIG. 6 for the right-hand plate 11*b*.

Figure 9:
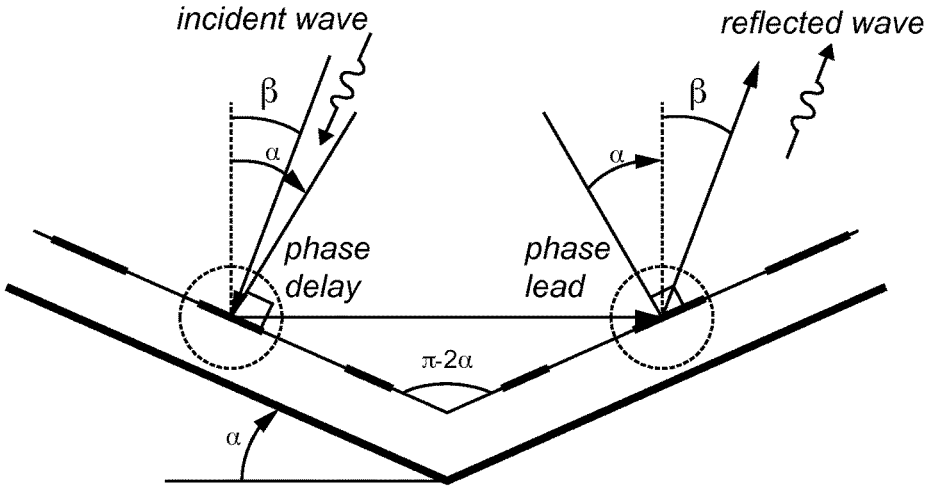
FIG. 9 illustrates the working of the device of FIG. 2 when the incident wave provides a phase lead relative to the configuration of the wave in normal incidence on the left-hand plate (panel) of the device.

FIG. 9 illustrates the working of the device of FIG. 2 in the second example, i.e. when the incident wave introduces a phase lead relative to the configuration of the wave in normal incidence on the left-hand plate (panel) 11*a* of the device 10. In this second case, it can be considered that, relative to the configuration in zero incidence (β=0), we are in the presence of the phenomenon of FIG. 6 for the left-hand plate 11*a* and then the phenomenon of FIG. 5 for the right-hand plate 11*b*. In other words, the supplementary phase delay and phase lead phenomena are permutated with respect to the first example.

In the first and second examples described here above (illustrated in FIGS. 8 and 9) it is shown that, when β is different from zero, the wave reflected by the first panel (left-hand panel) 11*a* should be intercepted by the second panel (right-hand panel) and should not be evanescent (the angle of reflection involving the ray reflected in the dielectric material). This constraint is all the greater as the angle α is small (for example, for α=10°, we have β maximal equal to 0.89° and for α=22.5°, we have β maximal equal to 4.85°).

In other words, there are limits for the angle β in order to preserve the dihedral effect and so that that the reflecting array is not reached at a glancing incidence (it can be recalled that this effect is also present in a classic dihedron). The dihedron is then said to be characterized by an angle of aperture. This angle of aperture can be increased by making a array of dihedrons. Thus, it becomes quite appropriate to have dihedrons 10 according to the present invention that are compact.

6.5 Shape of the Radiating Elements of Each Reflector Array

It is possible to choose from among several shapes for the radiating elements (also called cells) constituting each reflector array 14*a*, 14*b*: annular elements, circular elements, rectangular elements, square-shaped elements. The choice of a cell shape is made essentially as a function of the total range of phase shift that can be obtained by varying the sizes of the cells, as well as the frequency behavior of the phase shift law. Using simulations, it is shown that an annular cell is a good compromise if it is sought to have the maximum possible excursion for the phase shift with the best possible linearity on the widest possible range of frequency.

6.6 Pitch of Each Reflector Array

The pitch of each reflector array 14*a*, 14*b* is chosen to limit as far as possible the increases in the levels of side lobes (especially the array lobes): this pitch is therefore chosen to be smaller than λ/2, with X being the working wavelength.

However, this array pitch should not be too small if it is sought to have a large possible variation of phase shift between the cells (the variation being fixed by the size). The choice is based on the comparison of simulations between an array pitch of λ/2 and an array pitch of λ/3. The result of the simulations shows that the array pitch of λ/3 is preferable because it induces side lobes of a level lower than for an array pitch of λ/2.

6.7 Size of Each Reflector Array

The size of each reflector array 14*a*, 14*b* (size of each panel 11*a*, 11*b*) influences the maximum RCS level of the device 10 (dihedron with two reflector arrays). A compromise therefore has to be found between array size and maximum level of RCS. A comparison can be made with the metal dihedron of a same size, given that, for this metal dihedron, the RCS is the maximum.

6.8 Improving the Bandwidth

As in the case of every array constituted by frequency selective elements, the bandwidth of the solution proposed here above is limited.

However, for many applications, the bandwidth is not necessarily a constraint. For an automobile anti-collision radar for example, the frequency of use is known and fixed. Broadband is therefore not necessary. This is also the case for identification type applications.

If it is desired to obtain multi-frequency operation (i.e. operation possible at different, possibly separated, frequencies), each plate 11*a*, 11*b* comprises for example at least one other array of radiating elements making it possible to introduce a deviation relative to the specular reflection, for another given operating frequency. In other words, each plate comprises N reflector arrays each having a distinct operating frequency with N greater than or equal to 2. We must also note the possibility of obtaining making the pitch of the array vary according to a given law of variability.

Figure 10:
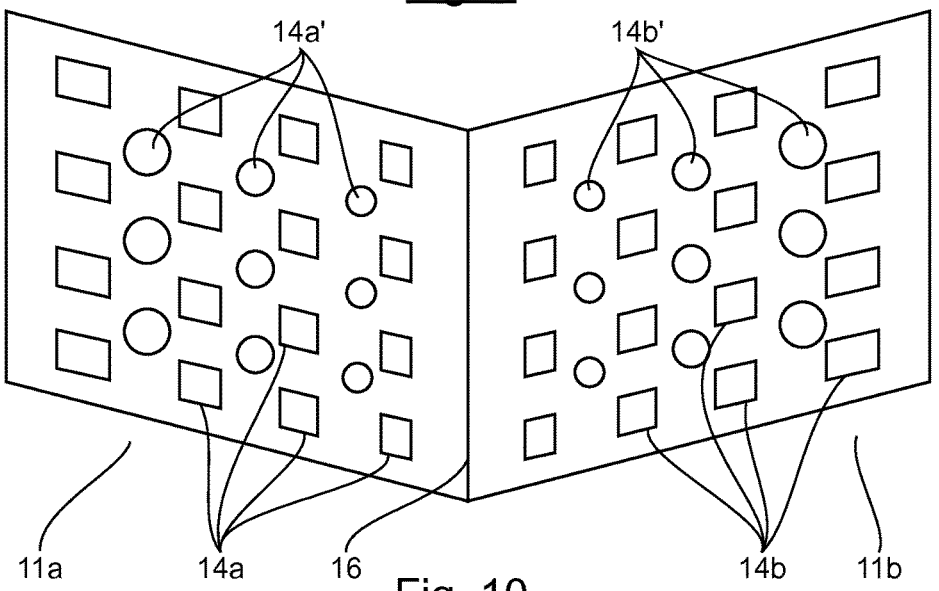
FIG. 10 illustrates one variant of the device of FIG. 3 in which the device has two possible operating frequencies.

FIG. 10 illustrates a variant of the device of FIG. 3 in which the device has two possible operating frequencies (N=2):

the first relies on first arrays of radiating element 14*a*, 14*b* (identical to those of FIG. 3 with radiating elements that are rectangular patches); and the second relies on second arrays of radiating elements 14*a*', 14*b*' (with radiating elements that are circular patches).

If broadband operation is to be obtained, a single array of radiating elements is enough for each plate but the basic element must be a broadband element. This property can be obtained with adapted geometries of elements (for example an element constituted by several resonators, printed on a same layer or on a multi-layer structure).

6.9 First Variant: Minimizing the RCS

By modifying the phase law on the array, it is possible to minimize the RCS instead of maximizing it. Steps are taken in this case to send back the incident wave in a direction different from that of the radar in the case of a mono-static configuration. This extension makes it possible to address stealth applications.

6.10 Second Variant: Modulation of the Phase Law as a Function of Time

Figure 11:
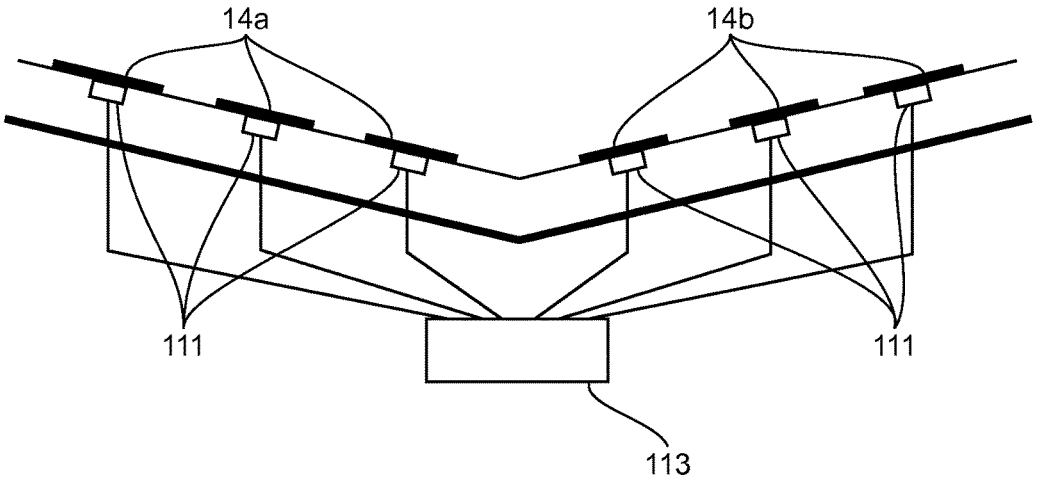
FIG. 11 illustrates another variant of the device of FIG. 3 in which the device comprises means for modulating the phase law as a function of time.

In a second variant (illustrated in FIG. 11), the device comprises means for modulating the phase law as a function of time, thus modulating the RCS of the device as a function of time (RCS agility). The phase shift produced by each element of each array 14*a*, 14*b* is for example controlled by an active circuit (phase shifter circuit) 111. In this case, the radiating elements are radiating elements each introducing a variable phase shift (and no longer a fixed phase shift as in the example of FIGS. 2, 3 and 7 to 9), and the modulation means comprise, for each array of radiating elements, a plurality of active circuits 111, each controlling the phase shift of one the radiating elements. This plurality of active circuits is itself controlled by an appropriate command device (processor for example) 113 receiving an instructed value at input that indicates the desired variation of the RCS of the device.

Such RCS agility makes it possible for example to particularize the signature of the device (dihedron) and therefore to facilitate its identification.

An exemplary embodiment of the present disclosure provides a technique for adapting (maximizing or minimizing) the equivalent radar cross-section (RCS) of a device having a flattened dihedral shape (i.e. the shape of a dihedron, the two plates of which mutually form an angle of $\pi-2\alpha$, with $0<\alpha<\pi/4$), the space requirement of this dihedron being smaller than that of a classic metal dihedron, the two plates of which mutually form an angle of $\pi/2$.

An exemplary embodiment provides a technique of this kind which (unlike the Van Atta array) does not require printed interconnection lines between different array elements.

An exemplary embodiment provides a technique of this kind using an entirely passive structure (unlike in the case of heterodyne retrodirective arrays) thus making it far simpler, less expensive and entirely autonomous from an energy viewpoint.

An exemplary embodiment provides a technique of this kind that enables multi-frequency functioning (i.e. functioning possible at several, possibly separated, operating frequencies).

An exemplary embodiment provides a technique of this kind that is simple to implement and costs little.

An exemplary embodiment provides a technique of this kind that offers an RCS that can be modulated according to time (i.e. a technique with RCS agility).

Although the present disclosure has been described with reference to one or more examples, workers skilled in the art will recognize that changes may be made in form and detail without departing from the scope of the disclosure and/or the appended claims.

The invention claimed is:

1. A dihedral-shaped device comprising:

first and second plates that mutually form an angle of $\pi-2\alpha$, with $0<\alpha<\pi/4$, wherein each plate comprises:

a ground plane, at least one dielectric layer, and an array of radiating elements, including a first array of radiating elements of the first plate and a second array of radiating elements of the second plate, an incident wave being reflected by the device through double reflection on both plates, and wherein:

the first array of radiating elements of the first plate enables a first phase shift to be generated, from an exterior of the first plate towards a center of the dihedral in following a first axis perpendicular to an axis of intersection of the first and second plates, according to a determined phase law, and the second array of radiating elements of the second plate enables a second phase shift to be generated, from an exterior of the second plate towards the center of the dihedral in following a second axis perpendicular to said axis of intersection of the first and second plates, according to the determined phase law, the first and second phase shifts produced by the first and second arrays of radiating elements of the first and second plates making it possible to introduce a deviation relative to a specular reflection for a given operating frequency.

2. The dihedral-shaped device according to claim 1, wherein, for an incident wave forming an angle $\alpha$ with the normal to the surface of that one the first and second plates that receives said incident wave, the phase law is written as follows:

$\gamma=k_0\, d(\cos\alpha-\sin\alpha)$, where $k_0=2\pi c/f_0$ is the wave number at the working frequency $f_0$, and d is the pitch of the array, so that the deviation relative to the specular reflection is: $\pi/2-2\alpha$, towards the center of the dihedral, and the device reflects an incident wave in the direction from which it has come, in order to increase the equivalent radar cross-section of the device.

3. The dihedral-shaped device according to claim 1, wherein, for an incident wave forming an angle $\alpha$ with the normal to the surface of that one the first and second plates that receives said incident wave, the phase law is different from:

$\gamma=k_0\, d(\cos\alpha-\sin\alpha)$, where $k_0=2\pi c/f_0$ is the wave number at the working frequency $f_0$, and d is the pitch of the array, so that the device reflects an incident wave in a direction different from that from which it has come, in order to reduce the equivalent radar cross-section of the device.

4. The dihedral-shaped device according to claim 1, wherein the device comprises means for modulating said phase law as a function of the time, enabling the equivalent radar cross-section of the device to be modulated as a function of the time.

5. The dihedral-shaped device according to claim 4, wherein the radiating elements are radiating elements each introducing a variable phase shift, and said modulation means comprise, for each array of radiating elements, a plurality of active circuits each controlling the phase shift of one of said radiating elements.

6. The dihedral-shaped device according to claim 1 wherein, for each plate, the radiating elements are radiating elements printed on said at least one dielectric layer.

7. The dihedral-shaped device according to claim 1 wherein, for each array of radiating elements, the phase shift between two successive radiating elements, from the exterior to the center of the dihedral in following said first or second axis perpendicular to the axis of intersection of the first and second plates, is obtained by a modification of at least one dimension of the radiating elements.

8. The dihedral-shaped device according to claim 1 wherein a pitch of each array of radiating elements is smaller than $\lambda/2$, with $\lambda$ being a working wavelength.

9. The dihedral-shaped device according to claim 1 wherein each plate comprises at least one other array of radiating elements, making it possible to introduce a deviation relative to the specular reflection for another given operating frequency.

10. The dihedral-shaped device according to claim 1 wherein the radiating elements are radiating elements each introducing a fixed phase shift.

* * * * *